United States Patent [19]

Price, Jr. et al.

[11] Patent Number: 4,623,106

[45] Date of Patent: Nov. 18, 1986

[54] REENTRY VEHICLE HAVING ACTIVE CONTROL AND PASSIVE DESIGN MODIFICATIONS

[75] Inventors: Donald A. Price, Jr., Palo Alto; William E. Brandt, Sebastopol; Jan Verheul, Sunnyvale, all of Calif.

[73] Assignee: The United States of America as represented by the Secretary of the Navy, Washington, D.C.

[21] Appl. No.: 664,634

[22] Filed: Oct. 25, 1984

[51] Int. Cl.[4] ..... F42B 15/02

[52] U.S. Cl. ..... 244/3.1; 244/3.22; 244/160

[58] Field of Search ..... 244/3.1, 3.15, 3.21, 244/3.22, 160; 102/489

[56] References Cited

U.S. PATENT DOCUMENTS

| | | | |
|---|---|---|---|
| 2,951,659 | 9/1960 | Yoler | 244/3.22 |
| 3,067,681 | 12/1962 | Beman | 244/3.19 |
| 3,132,590 | 5/1964 | Hall | 244/3.19 |
| 3,164,338 | 1/1965 | Cooper et al. | 244/3.21 |
| 3,411,736 | 11/1968 | Kelly | 244/3.15 |
| 3,652,034 | 3/1972 | Schindler et al. | 244/3.1 |
| 3,843,076 | 10/1974 | King et al. | 244/3.22 |
| 4,340,197 | 7/1982 | Campbell | 244/160 |

*Primary Examiner*—Charles T. Jordan

*Attorney, Agent, or Firm*—R. F. Beers; C. D. B. Curry; G. L. Craig

[57] ABSTRACT

A modular improved forward section and improved aft section containing an active-control package are disclosed which can be retrofitted to existing sphere-cone geometry reentry bodies (RBs) and which will provide improved aerodynamic performance and deployment accuracy of the RBs independent of missile error sources and drop sequence. An aft section containing control electronics, a propulsion system and steering jets permits the improve RB to actively correct for attitude and velocity dispersions occurring throughout the flight profile.

6 Claims, 1 Drawing Figure

REENTRY VEHICLE HAVING ACTIVE CONTROL AND PASSIVE DESIGN MODIFICATIONS

BACKGROUND OF INVENTION

1. Field of Invention

The invention relates to an apparatus for improving the capabilities of existing reentry bodies (RBs). More specifically, the invention relates to retrofitting existing RBs with an increased fineness forward section and an aft section containing active control components such that the improved RB can correct for dispersive factors throughout the flight profile and is made independent of missile error sources and the RB deployment sequence. Conventional reentry bodies are, more accurately, ballistic reentry bodies (BRBs) in that they follow a trajectory determined by their release parameters. The reentry vehicles of the present invention permits conventional BRBs to have increased capability beyond the release parameters and are referred to, with the improvements, as simply RBs.

2. Description of Prior Art

Reentry bodies (RBs) carried aboard ballistic missiles are typically designed to achieve an accuracy goal with a minimum size and weight. Additionally, RBs are generally released sequentially from a maneuvering missile "bus" such that each RB has a target impact footprint constrained by that RB's position in the release sequence and whatever deployment errors occur in the release of preceeding RBs propagate to the release of subsequent RBs. Therefore, improvement in the performance and accuracy of RBs may be achieved by both passive and active design modification.

Passive design improvement of existing RBs to obtain significantly increased performance is achieved by retrofitting a new forward section to any existing RB such that fineness (the ratio of length to width) of the RB is greatly increased as well as static margin. Thus for minimal penalties in increased size and weight, greatly increased stability in the presence of aerodynamic and atmospheric dispersive factors is achieved.

Active design improvement of existing RBs presents a way of providing active control to the RBs to minimize the RB deployment errors resulting from release mechanisms, release sequence and hostile exo-atmospheric nuclear encounters. RB deployment accuracy is limited by the missile structural flexibility combined with the operation of the solid propellant gas generator control system. Since the gas generator must operate continuously once started, the on-off cycling with pulse width modulation of two thrust levels leads to continuing excitation of structure flexing and rigid body angular motion. This limits the pointing accuracy and generates RB tip-off rate residuals causing lateral velocity uncertainties. The explosive bolt separation upon release plus impulsive separation velocity and spin-up cause additional dispersive velocities. The RB traverse through the time modulated reaction control plumes of the missile further degrades the deployment accuracy due to relative position, attitude and velocity uncertainties between the RB and the missile bus as it maneuvers away and thrusts to the next RB drop. The mechanical misalignment between a RB and the missile bus propagates the separation velocity into the lateral direction. A larger separation velocity is desirable to minimize time spent subject to plume effects while a smaller separation velocity minimizes the effects of misalignment. The distribution of deployment velocity errors is highly asymmetric—the axial error being about twice the lateral error. To minimize the impact dispersion caused by the velocity errors, the RB is usually released in the null miss direction such that the axial component of velocity changes to trajectory is cancelled by flight time at the target. Thus the only deployment contribution to target impact error is the smaller lateral velocity error. However, the consequence of null miss pointing is that the RB reenters the atmosphere having a non-zero angle of attack with uncertainties caused by missile pointing, RB tip-off and spin-rate errors. The subsequent angle of attack convergence in the presence of these errors yields significant additional reentry dispersions when compared to zero angle of attack reentry. However, trade off of missile deployment error versus reentry error results in significant improvement using null miss pointing since missile deployment error predominates.

Several attempts have been made within the prior art to reduce error in RB deployment and thus improve accuracy. These include reduced missile bus thrust levels, increased settling down time to damp out rigid body rates and structural flexing, reduced separation velocity to reduce misalignment errors, plume avoidance maneuvers to keep the RB out of the bus plume during transit to the next drop, near nozzle off to minimize RB time in the plume during initial deployment, canted nozzles on the bus, and improvements in the bus control system sensors and electronics. These approaches, however, cause a significant increase in the duration of the deployment process which result in missile performance penalties as well as increasing vulnerability of the bus. The plume avoidance maneuvers significantly complicate the missile operation and the pre-set computations for fire control. RB loading arrangements, canted toward the center of the missile because of shroud clearance contraints, require complicated missile bus maneuvers to avoid RBs bumping into one another. The plume uncertainties during this process further reduce the effectiveness of the plume avoidance maneuvers. The gas dynamics of the time modulated plume are not well understood and are extremely difficult to determine empirically. The extended deployment time further exacerbates the velocity uncertainties between the guidance drop signal and the actual drop time. The mass properties and structural flexibility of the bus exhibit large variations as successive RBs are dropped making RBs deployed later in the sequence more sensitive to the various error sources. The present invention provides a way to avoid these limitations of the prior art by retrofitting a new forward and aft section to existing RBs to greatly improve their performance.

SUMMARY OF INVENTION

Briefly described is a novel modification to conventional reentry bodies (RBs) providing greatly increased performance to the RBs by minimizing dispersive effects due to RB aerodynamic configuration, reentry lift, deployment errors and hostile nuclear encounters. A new forward section is retrofitted to existing RBs providing an increased fineness ratio for the RB and increased static margin. The new forward section is also configured to provide controlled ablative erosion on reentry to minimize reentry lift dispersion. A new aft section is also retrofitted to provide active propulsion/-control to the RB to correct for errors resulting from deployment or hostile nuclear encounter.

A primary object of invention is to provide an improved ballistic reentry body. A second object of invention is to provide a way of improving conventional RBs by retrofitting a forward section having controlled shape stability under ablative erosion and an aft section having active propulsion/control.

DESCRIPTION OF ORIGINAL DRAWING

The drawing is a schematic view of the invention showing the retrofitted forward and aft sections.

DESCRIPTION OF THE PREFERRED EMBODIMENT

Figure 1:
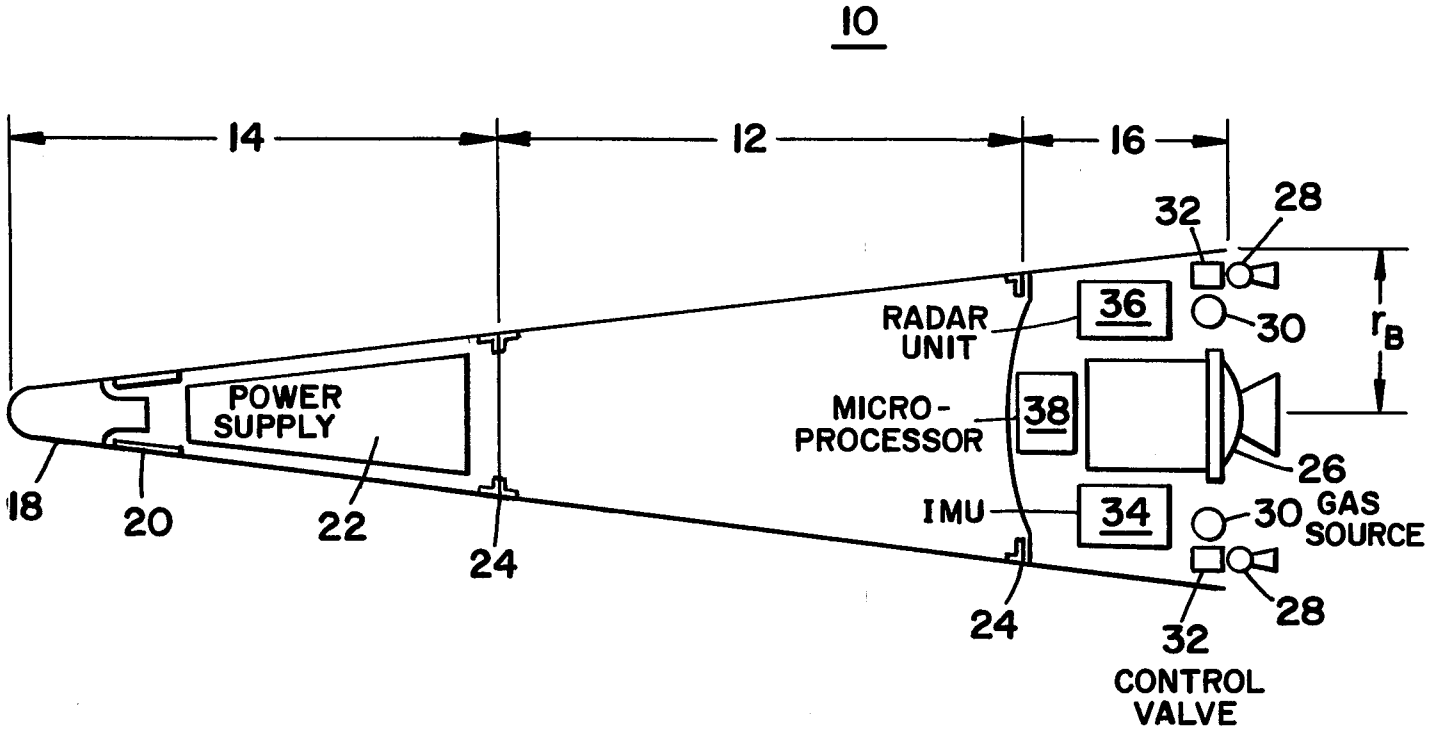

Referring to the FIGURE, the improved RB 10 of the present invention is shown with the retained mid-section 12, the new retrofitted forward section 14 and the new retrofitted aft section 16. The new forward section 14 is substantially longer than the forward section it replaces and has a nosetip 18 of substantially smaller radius of curvature. This increases the overall fineness (ratio of length to width) of the improved BRB. Conventional prior art RBs are designed to minimize size and weight as primary constraints. The improved RB provided by the new forward section 14 has significantly increased static margin for stability, ballistic factor for reduced CEP due to atmospheric effects and volume for power supplies with a minimum penalty in size and weight. The nosetip 18 and a carbon/carbon collar 20 just aft of the nosetip are also fabricated of materials such that shape stability of the forward section is maintained under the ablative erosion of reentry such that additional lift coefficients are minimized over prior art reentry bodies. The increased volume of the new forward section 14 also permits inclusion of a larger more powerful power supply 22 to provide power to the active control components located in the new aft section 16.

The new aft section 16 is shown retrofitted to an existing RB mid-section 12 via a manufacturing joint 24. The new aft section 16 providing active control of the RB incorporates a solid rocket motor 26 for propulsion and two nozzle clusters 28 for RB attitude control. The nozzle clusters 28 are driven by a gas source 30 regulated by control valves 32. The gas source 30 may be either a gas generator or a toroidal cold gas storage unit. Guidance and control for the rocket motor 26 and nozzle clusters 28 include an inertial measurement unit (IMU) 34 and radar unit 36 controlled by a microprocessor and associated electronics 38. The radar unit 36, although included with the other components used for active control of the RB, is primarily intended to provide information to the RB in the endo-atmospheric portion of the flight.

The accuracy of the improved active control RB 10 is then dependent only on the measurement accuracy of the inertial measurement unit 34 and the radar system 36 and the ability to correct the measured velocity deviations by control of the rocket motor 26 and nozzle clusters 28. Thus the deployment accuracy becomes independent of the missile error sources and RB deployment sequence described previously. Further, the capability of the improved, active control RB to independently control its pointing permits the missile to operate in a more efficient mode thereby improving overall payload/range performance. That is, the missile can now deploy RBs "on-the-run" by separating them as soon as the missile guidance system signals attainment of the designated trajectory conditions for that RB. The missile then maneuvers to the next RB deployment condition without regard to plume interaction with the RB. The active RB of the present invention uses its IMU 34 and electronics 38 to measure mechanical misalignment through in-flight velocity matching with the missile guidance system and measures the angular motions and velocity prior to separation, through the separation event and during subsequent traverse of the missile plume. Since the RB is providing its own measurement and control during deployment, the separation system can be simplified by eliminating the RB spin-up mechanism and relaxing tolerances. That is, no specific linear and rotational separation velocity need be imparted to the RB and accounted for by the missile. Thus significant reduction in weight and complexity of the separation/release mechanisms is achieved by having the RB perform the deployment velocity correction. After passage through the missile plume, the RB corrects the deployment errors by control of the rocket motor 26 and nozzle clusters 28 and verniers to the nominal pre-set deployment velocity. The pre-set value could be simply set to zero so that the missile guidance system need not adjust its deployment condition for the nominal deployment velocity. Therefore, since the RB measures the missile motion up to separation, the effects of missile variability from drop to drop resulting from misalignment and separation errors are eliminated. The RB attitude can be oriented for zero reentry angle-of-attack using the nozzle clusters 28 and, similarly, spun up to a small roll rate to minimize gas usage or controlled with zero spin until reentry. A roll rate of about twenty percent of conventional RBs is adequate since virtually zero pitch rate residuals are achieved with the RB control system resulting in very small coning motion. At low altitudes (e.g. below 100,000 ft.), the RB can be spun up to higher roll rates, again using the control gas 30 and nozzle clusters 28, to minimize lift induced dispersions and yet controlled to avoid roll resonance and spin through zero. This capability to measure and correct reentry lift dispersions by appropriate modulation of roll rate is another novel feature of the improved RB.

The active control RB of the present invention has the additional unique capability to measure and correct velocity and attitude despersions due to hostile exo-atmospheric nuclear encounters. The digital force balance accelerometers within the IMU 34 measure and store the velocity impulse induced by x-ray deposition in the heat shield and subsequent out gassing reaction in spite of the control system shut down. The mechanically stored velocity impulse is recovered during the first re-balance of the accelerometers. Correction for magnitude and number of encounters is limited only by the capacity of the control gas source 30.

Therefore the present improved RB 10 has significantly increased aerodynamic performance by virtue of the new forward section 14 and the active control aft section 16 permits the missile to operate more efficiently and recover any performance loss due to increased RB weight. The solid rocket motor 26 and nozzle clusters 28 correct for velocity deployment errors and the rocket motor also increases BRB footprint capability by varying burn direction relative to RB deployment conditions in a manner analogous to the conventional missile maneuver to each sequential deployment. The improved RB having individual propulsion and attitude control, therefore, provides targeting of any target within the footprint boundary of the missile for each RB. Thus the full range capability of the missile may be utilized resulting in a great increase in range of the improved RB of the present invention. Targeting of current RBs with the missile bus is limited in footprint coverage by the sequential drop procedure.

Clearly, the instant invention may be modified and practiced by those skilled in the art without departing from the scope of the appended claims.

What is claimed is:

1. An improved reentry body (RB) for transportation aboard a ballistic missile, said improvement entailing replacement of specific sections of a conventional ballistic reentry body (BRB) having a forward, mid and aft section and comprising:

(a) a new forward section having increased length and decreased nosetip radius retrofitted to the mid section, said new forward section having said nosetip and a smooth annular collar just aft of said nosetip constructed of materials such that shape stability of said improved RB is maintained under ablative erosion of reentry; and (b) a new aft section retrofitted to said mid section, said new aft section having an active control means to actively measure and correct for velocity dispersions occurring from RB deployment.

2. The improved RB of claim 1 wherein said active control means further includes:

(a) a propulsion system;

(b) an attitude and roll control means;

(c) a control gas source connected to said attitude control means;

(d) a measurement means receiving angular motion and acceleration inputs imparted to said RB and having an output;

(e) an electronic control means, said electronic control means receiving input signals from said missile and said measurement means and transmitting electronic control signals to said propulsion system, said control gas source and said attitude and roll control means such that active velocity, attitude, and roll control of said RB is obtained upon release from said missile.

3. The improved RB of claim 2 wherein said propulsion system is a rocket motor.

4. The improved RB of claim 2 wherein said attitude and roll control means is a pair of control nozzles located opposite one another on said aft section and operatively connected to said control gas source.

5. The improved RB of claim 2 wherein said measurement means is an inertial measurement unit.

6. The improved RB of claim 2 wherein said electronic control means is a programmable microprocessor.

* * * * *